US008012309B2

(12) United States Patent
Paré et al.

(10) Patent No.: US 8,012,309 B2
(45) Date of Patent: Sep. 6, 2011

(54) METHOD OF MAKING WET EMBOSSED PAPERBOARD

(75) Inventors: Éric Paré, Kingsey Falls (CA); Yves Martin, Kingsey Falls (CA); Matieu Jacques, Kingsey Falls (CA)

(73) Assignee: Cascades Canada ULC, Montreal, Quebec (CA)

( * ) Notice: Subject to any disclaimer, the term of this patent is extended or adjusted under 35 U.S.C. 154(b) by 0 days.

(21) Appl. No.: 12/551,247

(22) Filed: Aug. 31, 2009

(65) Prior Publication Data

US 2010/0038045 A1 Feb. 18, 2010

Related U.S. Application Data

(63) Continuation-in-part of application No. 12/013,197, filed on Jan. 11, 2008, now abandoned.

(60) Provisional application No. 60/880,048, filed on Jan. 12, 2007.

(51) Int. Cl.

| | |
|---|---|
| ***D21H 27/30*** | (2006.01) |
| ***B31F 1/07*** | (2006.01) |
| ***D21F 11/00*** | (2006.01) |

(52) U.S. Cl. ..... 162/117; 162/123; 162/181.1; 162/205; 156/219

(58) Field of Classification Search ..... 162/109, 162/117, 123–132, 141, 147, 149, 158, 204–206, 162/181.1; 156/209, 219; 428/156, 172
See application file for complete search history.

(56) References Cited

U.S. PATENT DOCUMENTS

| | | | | |
|---|---|---|---|---|
| 999,951 | A | * | 8/1911 | Bird |
| 1,849,065 | A | * | 3/1932 | Biederman |
| 2,402,966 | A | | 7/1946 | Linzell |
| 2,483,405 | A | * | 10/1949 | Francis, Jr. |
| 2,622,051 | A | | 12/1952 | Hermanson et al. |
| 2,744,624 | A | * | 5/1956 | Hoogstoel et al. |
| 2,890,540 | A | | 6/1959 | Britt |
| 3,042,577 | A | | 7/1962 | Thomas |
| 3,354,247 | A | * | 11/1967 | Zehender et al. |
| 3,379,608 | A | | 4/1968 | Roberts et al. |
| 3,576,711 | A | | 4/1971 | Baldwin |
| 3,848,043 | A | | 11/1974 | Garrick et al. |
| RE28,459 | E | | 7/1975 | Cole et al. |
| 3,947,537 | A | * | 3/1976 | Buntin et al. |

(Continued)

FOREIGN PATENT DOCUMENTS

| | | |
|---|---|---|
| EP | 1314817 | 5/2003 |

(Continued)

OTHER PUBLICATIONS

Machine Translation of JP Publication No. 08260397 A, Published on Oct. 1996.*

*Primary Examiner* — José A Fortuna
(74) *Attorney, Agent, or Firm* — Sutherland Asbill & Brennan LLP

(57) ABSTRACT

A process for manufacturing an embossed paperboard comprising the steps of: forming a wet mat including more than 60 wt % of cellulose fibers; pressure molding, with at least one embossing roll, the wet mat having 20 to 70 wt % solid to create a nested surface texture thereon; and drying the embossed wet mat to obtain the embossed paperboard with a grammage ranging between 125 and 1500 grams per square meter.

21 Claims, 17 Drawing Sheets

U.S. PATENT DOCUMENTS

| | | | | |
|---|---|---|---|---|
| 4,075,382 | A | | 2/1978 | Chapman et al. |
| 4,153,503 | A | | 5/1979 | Booth et al. |
| 4,169,748 | A | * | 10/1979 | Clarke et al. ..... 156/62.2 |
| 4,238,190 | A | * | 12/1980 | Rejto |
| 4,257,842 | A | | 3/1981 | Ciaccia et al. |
| 4,326,633 | A | * | 4/1982 | Schillinger et al. |
| 4,338,368 | A | * | 7/1982 | Dotts et al. |
| 4,356,059 | A | * | 10/1982 | Hostetler |
| 4,387,144 | A | * | 6/1983 | McCallum et al. |
| 4,474,293 | A | * | 10/1984 | Osborne |
| 4,612,224 | A | * | 9/1986 | Davis |
| 4,698,257 | A | * | 10/1987 | Goll |
| 4,708,247 | A | * | 11/1987 | Liebel |
| 4,735,738 | A | * | 4/1988 | Willman |
| 4,849,054 | A | * | 7/1989 | Klowak |
| 5,002,186 | A | * | 3/1991 | Cooper |
| 5,087,324 | A | | 2/1992 | Awofeso et al. |
| 5,175,041 | A | * | 12/1992 | Webb et al. |
| 5,223,092 | A | | 6/1993 | Grinnell et al. |
| 5,232,535 | A | | 8/1993 | Brinley |
| 5,266,250 | A | | 11/1993 | Kroyer |
| 5,299,691 | A | | 4/1994 | Winski |
| 5,314,584 | A | * | 5/1994 | Grinnell et al. |
| 5,316,622 | A | | 5/1994 | Babinsky et al. |
| 5,374,468 | A | | 12/1994 | Babinsky et al. |
| 5,437,908 | A | | 8/1995 | Demura et al. |
| 5,637,194 | A | * | 6/1997 | Ampulski et al. |
| 5,862,750 | A | * | 1/1999 | Dell'Olmo |
| 6,036,909 | A | * | 3/2000 | Baum |
| 6,063,239 | A | * | 5/2000 | Howland et al. |
| 6,186,936 | B1 | | 2/2001 | Smith et al. |
| 6,287,247 | B1 | * | 9/2001 | Dees et al. |
| 6,302,998 | B1 | * | 10/2001 | Burgess |
| 6,494,990 | B2 | | 12/2002 | Bazaj et al. |
| 6,503,370 | B2 | * | 1/2003 | Hollmark et al. |
| 6,554,963 | B1 | * | 4/2003 | Botelho et al. |
| 6,558,511 | B2 | * | 5/2003 | Dwiggins et al. |
| 6,585,856 | B2 | * | 7/2003 | Zwick et al. |
| 6,773,548 | B1 | * | 8/2004 | Thibierge et al. |
| 6,811,652 | B2 | | 11/2004 | Hollmark |
| 6,846,172 | B2 | | 1/2005 | Vaughn et al. |
| 7,037,960 | B2 | | 5/2006 | Ukai |
| 7,108,765 | B2 | * | 9/2006 | Halabisky |
| 7,235,156 | B2 | | 6/2007 | Baggot |
| 7,758,724 | B2 | * | 7/2010 | Akai et al. ..... 162/117 |
| 2002/0060008 | A1 | | 5/2002 | Hollmark et al. |
| 2004/0076798 | A1 | | 4/2004 | Larsson et al. |
| 2004/0096604 | A1 | | 5/2004 | Van de Camp |
| 2005/0133176 | A1 | | 6/2005 | Vinson |
| 2005/0136204 | A1 | * | 6/2005 | Qiu et al. ..... 428/36.91 |
| 2006/0037724 | A1 | * | 2/2006 | Akai et al. ..... 162/117 |
| 2006/0278357 | A1 | * | 12/2006 | Suzuki et al. ..... 162/117 |
| 2008/0149292 | A1 | | 6/2008 | Scherb |
| 2008/0169072 | A1 | * | 7/2008 | Pare et al. ..... 162/117 |
| 2008/0302493 | A1 | * | 12/2008 | Boatman et al. ..... 162/109 |
| 2009/0126885 | A1 | * | 5/2009 | Akai et al. ..... 162/117 |
| 2010/0038045 | A1 | * | 2/2010 | Pare et al. ..... 162/117 |

FOREIGN PATENT DOCUMENTS

| | | | | |
|---|---|---|---|---|
| EP | 1630290 | A1 | | 3/2006 |
| EP | 1731296 | | | 12/2006 |
| EP | 1964968 | A1 | * | 9/2008 |
| GB | 1447077 | | | 8/1976 |
| JP | 06264400 | | | 9/1994 |
| JP | 08260397 | | | 10/1996 |
| JP | 11081177 | | | 3/1999 |
| JP | 2004183163 | | | 7/2004 |
| JP | 2008101283 | | | 5/2008 |
| WO | 2005073462 | | | 8/2005 |
| WO | 2005106116 | | | 11/2005 |
| WO | 2007046124 | | | 4/2007 |

* cited by examiner

METHOD OF MAKING WET EMBOSSED PAPERBOARD

CROSS-REFERENCE TO RELATED APPLICATIONS

This application is a continuation in part of application Ser. No. 12/013,197 bearing the same title and filed Jan. 11, 2008 by applicant, now abandoned, which claims priority of U.S. provisional patent application 60/880,048, filed on Jan. 12, 2007, the specifications of which are hereby incorporated by reference.

FIELD

The invention relates to embossing paperboards. More precisely, it relates to a wet embossed paperboard and a method and an apparatus for manufacturing same.

BACKGROUND

Embossing is the process of creating a three-dimensional image or design in paper and other ductile materials. It is typically accomplished with a combination of heat and pressure on the paper. This is achieved by using a metal die (female) usually made of brass or stainless steel and a counter die (male) that fit together and actually squeeze the fibers of the paper. This pressure and a combination of heat actuated "irons" raise the level of the image higher than the substrate and make it smooth. This can be performed on dry or wet papers. The process works because the paper is malleable; it will embrace and retain an image of whatever object is pressed against it.

A paperboard is a sheet of fibrous web material having a grammage higher than 125 grams per square meter, by comparison with papers which have a grammage below 125 grams per square meter. A paperboard is embossed to increase its volume and, simultaneously reduce the quantity of raw material necessary to manufacture the paperboard for a given thickness. It therefore increases the specific volume (or bulk).

However, dry embossing crushes the fibers of the paperboard and therefore weakens substantially the resulting paperboard. Dry embossing delaminate boards made of multiple plies.

Peak to peak embossing perforates the pulp-based substrate and therefore alters substantially its mechanical properties.

Techniques other than embossing to increase the volume of the paperboard are currently used but all yield unacceptable results with respect to volume of the paperboard, quantity of fibers used and strength of the resulting paperboard. Such techniques are, for example, reducing the wet pressing, reducing the refining, adding sawdust in the wet mat, adding mechanical pulp and chemicals.

SUMMARY

It is therefore an aim of the present invention to address the above mentioned issues.

According to a general aspect, there is provided a process for manufacturing an embossed paperboard. The process comprises the steps of: forming a wet mat including more than 60 wt % of cellulose fibers; pressure molding, with at least one embossing roll, the wet mat having 20 to 70 wt % solid to create a nested surface texture thereon; and drying the embossed wet mat to obtain the embossed paperboard with a grammage ranging between 125 and 1500 grams per square meter.

The step of forming the wet mat can further comprise superposing 1 to 12 paper plies, preferably 2 to 12 paper plies, more preferably 3 to 9, and most preferably 7 to 9 paper plies.

Typically, the embossed paperboard produced will have a grammage of 350 to 450 g/m$^2$ (dry weight) for embodiments having 7 to 9 paper plies. Typically, the grammage will be within a range of 200 à 1200 g/m$^2$, preferably 250 to 900 g/m$^2$, and more preferably 300 to 500 g/m$^2$, depending on the number of plies and of the final application.

The pressure molding step can further comprise applying a pressure ranging between 50 and 600 pounds per linear inch (PLI), preferably between 100 and 500 PLI, and typically between 250 and 295 (the range of 250 to 295 can be associated with embossed paperboards having 7 to 9 paper plies, for example). The pressure molding step can be carried out with two embossing rolls having spaced-apart knobs in meshing engagement, the two embossing rolls being synchronously rotated.

In alternates embodiments, the solid content of the wet mat ranges between 35 and 55 wt % during the pressure molding step and/or the wet mat can comprise more than 80 wt % of cellulose fibers.

In alternates embodiments, the wet mat can comprise less than 30 wt % of inorganic fillers and/or the cellulose fibers of the wet mat comprises more than 60 wt % of recycled fibers.

The recycled fibers can comprise more than 40 wt % of old corrugated cardboard (OCC) fibers.

The embossed paperboard can have a specific volume density ranging between 1 and 6 cubic centimeter per gram, a tensile strength ranging between 100 and 700 Newtons per inch, a thickness ranging between 250 and 5 000 micrometers, a moisture content below 15 wt %, and/or a grammage ranging between 250 and 900 grams per square meter.

In an embodiment, the process also includes the step of decelerating the wet mat for carrying the pressure molding step. It can also include the step of accelerating the wet mat for carrying the drying step. It can also include the step of withdrawing excess water while carrying the pressure molding step.

According to another general aspect, there is provided an embossed paperboard comprising: a paper mat having a nested surface texture thereon created by pressure molding with at least one embossing roll when the paper mat contained between 20 to 70 wt % solid and then dried to contain less than 15 wt % of moisture content, the paper mat having more than 60 wt % of cellulose fibers and a grammage ranging between 125 and 1500 grams per square meter.

In this specification, the term "paperboard" is intended to mean paperboard, cardboards, chipboard, as well as boards including cellulose fibers and, more particularly, paperboards and boards thicker than 10 mils (0.01 inch). It includes medium and high weight paper substrates having a grammage higher than 125 grams per square meter. It includes, without limitation, virgin and recycled materials and single and multiply materials.

The term "secondary paper" is intended to mean any recycled fibers, waste papers, or other sources of pulp and fiber that come from a previously created product or process.

The term "virgin fibers" refer to fibers that come directly from original pulping processes.

The term "nested pattern" refer to a pattern wherein the depressions created on a first paperboard side are in register with the protuberances created on a second paperboard side, opposed to the first side, and vice-versa. Nested embossing pattern can be created with two embossment rolls, each having embossment knobs and the embossment knobs of one roll mesh between the embossment knobs of the other roll or with two embossment rolls, only one roll having embossment knobs and the other roll having a substantially smooth outer surface, which can be deformable.

DESCRIPTION OF THE DRAWINGS

FIG. 5 includes FIG. 5A, FIG. 5B and FIG. 5C, wherein

FIG. 7 includes FIG. 7A and FIG. 7B, wherein

FIG. 8 includes FIG. 8A and FIG. 8B, wherein

FIG. 9 includes FIG. 9A and FIG. 9B, wherein

FIG. 10 includes FIG. 10A and FIG. 10B, wherein

FIG. 11 includes FIG. 11A and FIG. 11B, wherein

FIG. 15 includes

FIG. 17 includes

It will be noted that throughout the appended drawings, like features are identified by like reference numerals.

DETAILED DESCRIPTION

Figure 1:
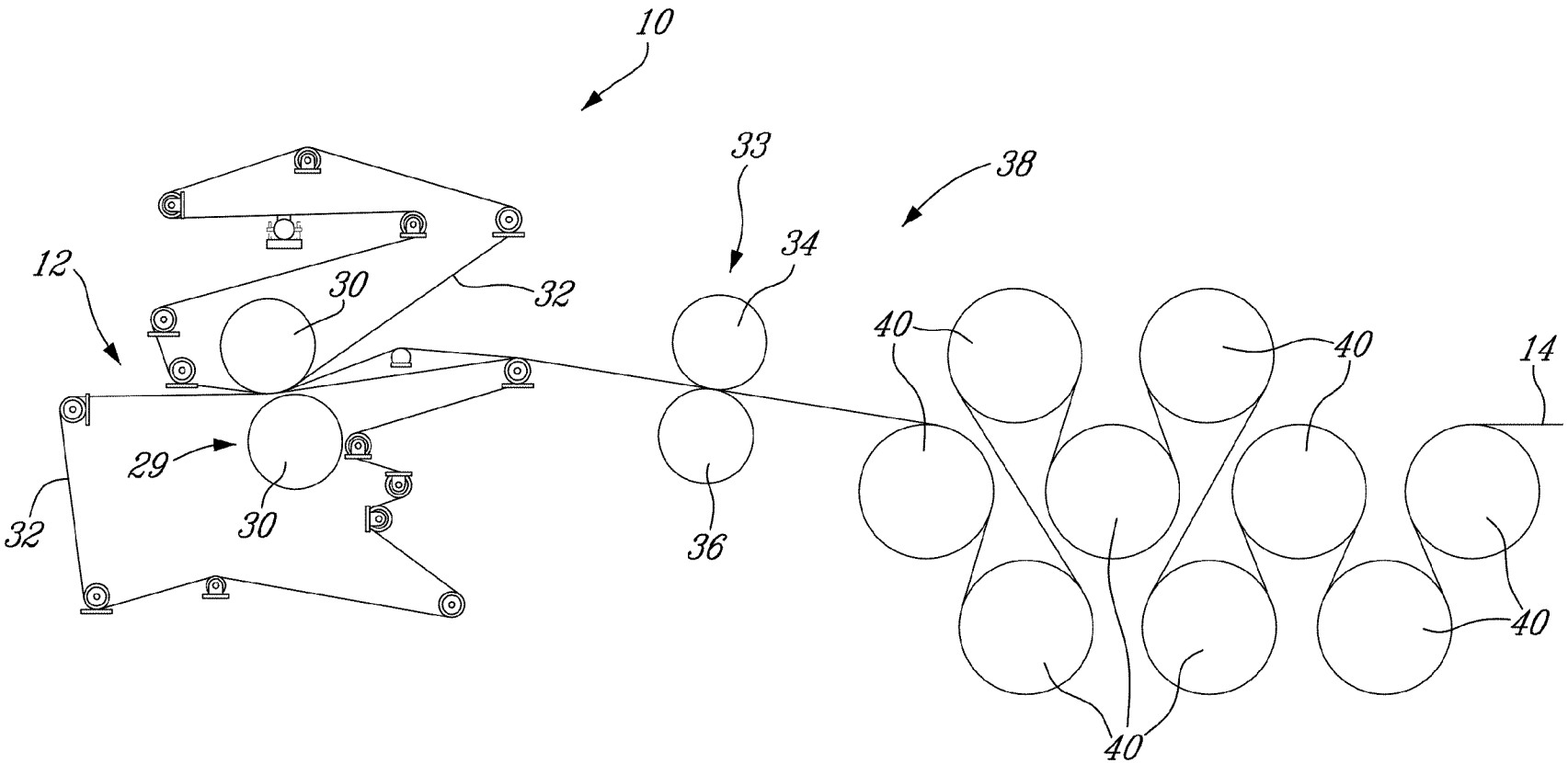
FIG. 1 shows an apparatus used to emboss a wet web in accordance with an embodiment.

Now referring to the drawings and, more particularly referring to FIG. 1, there is shown an apparatus 10 used for transforming and, more particularly, wet embossing a wet mat 12 into an embossed paperboard 14. Wet embossing allows a better pattern definition and keeps the paperboard cohesiveness.

The process for manufacturing the embossed paperboard 14 is designed for embossing the wet mat 12 which, prior to the embossing step, includes more than 60 wt % of cellulose fibers and has between 20 to 70 wt % solid. Following the process, the embossed paperboard 14 with a grammage ranging between 125 and 1500 grams per square meter is obtained.

The process includes the steps of forming the wet mat 12; pressure molding with at least one embossing roll the wet mat to create a surface texture thereon; and drying the embossed wet mat to obtain the embossed paperboard 14.

Figure 2:
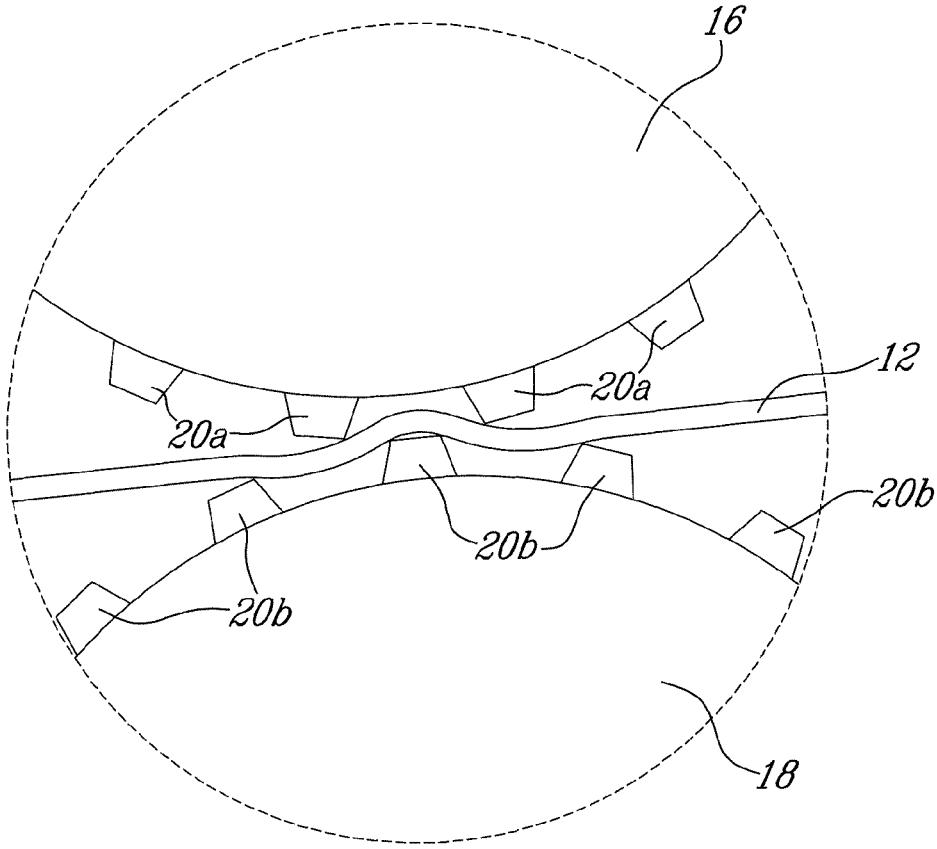
FIG. 2 is a schematic cross-sectional view of embossment rolls of the apparatus shown in FIG. 1, wherein both rolls include embossment knobs.
Figure 3:
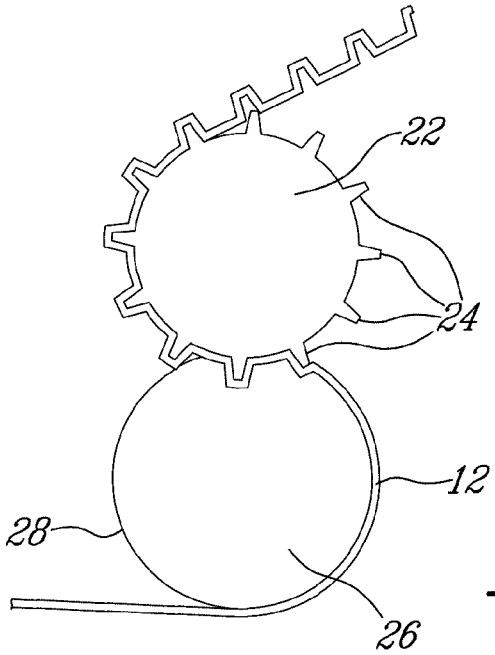
FIG. 3 is a schematic cross-sectional view of alternate embossment rolls of the apparatus shown in FIG. 1, wherein only one roll includes embossment knobs.

Embossing is typically performed by one of two embossing roll arrangements, knob-to-knob embossing or nested embossing. Knob-to-knob embossing, also referred to as peak-to-peak embossing, consists of axially parallel rolls juxtaposed to form a nip between the knobs on opposing rolls. As mentioned above, nested embossing patterns can be obtained with two embossment rolls. In a first embodiment, shown in FIG. 2, both rolls 16, 18 include embossment knobs 20 and the embossment knobs 20*a* of one roll 16 mesh between the embossment knobs 20*b* of the other roll 18. In an alternate embodiment, shown in FIG. 3, only one roll 22 has embossment knobs 24 and the other roll 26 has a substantially smooth outer surface 28, which can be deformable. Thus, the depressions created on one side of the mat nest with the protrusions created on the opposite mat side. In a third embodiment (not shown), only one roll 16 has embossment knobs 20 and the other roll 18 has depression created to receive the embossment knobs 20 of roll 16.

Referring back to FIG. 1, there is shown that the wet fibrous mat 12 is first formed from a supply of pulp fibers from an aqueous slurry in a well known manner. Most fibers are cellulose fibers, which can provide from secondary materials, virgin fibers, or a combination of both, as is well known in the art.

In an embodiment, the wet mat 12 includes more than 60 wt % of cellulose fibers. In an alternate embodiment, the wet mat 12 includes more than 80 wt % of cellulose fibers.

Additives may be added in the pulp to modify the appearance and/or physical characteristics of the paperboard produced. Many types of additives are well known in the art, examples of such well known additives are mineral fillers (or inorganic fillers), dry strength resins, retention and drainage aids (chemicals), sizing agents, etc.

The wet mat 12 can have a plurality of plies of superposed pulp-based material. In an embodiment, the paperboard has between 1 and 12 plies of pulp-based material. Light paperboards typically have two plies and have a grammage between 125 and 300 grams per square meter. Paperboards with a greater number of plies or thicker boards have a grammage of about 250 to 1500 grams per square meter. In an embodiment, the wet embossing apparatus and process are used to emboss paperboards having a grammage between 125 and 1500 grams per square meter. In an alternate embodiment, the wet embossing apparatus and process are used to emboss paperboards having a grammage between 275 and 900 grams per square meter, with seven to nine plies, for instance. The embossed paperboard produced can have a grammage of 350 to 450 g/m$^2$ (dry weight) for embodiments having 7 to 9 paper plies. Typically, the grammage will be within a range of 200 à 1200 g/m$^2$, preferably 250 to 900 g/m$^2$, and more preferably 300 to 500 g/m$^2$, depending on the number of plies and of the final application.

It is appreciated that the composition of each ply can vary. For example, in an embodiment, the outer plies, also referred to as liners, can have a first composition in pulp fiber while the inner plies, also referred to as fillers, can have a second pulp fiber composition.

For example, the wet mat can have seven plies and the outer plies (or liners), i.e. plies # 1 and # 7, can be made from pulp including between 60 and 80 wt % old corrugated cardboard (OCC) pulp and between 20 and 40 wt % recycled kraft boards. The inner plies (or fillers), i.e. plies # 2 to #6, can be made from 100 wt % OCC pulp. It is appreciated that in alternate embodiments, the outer and inner plies can have the same fiber content or that the ply fiber content can vary from the one described above.

As mentioned above, the wet mat fibers can include secondary fibers as well as virgin fibers. In an embodiment, the wet mat 12 can include between 50 and 100 wt % secondary fibers. The secondary fibers can include low grade fibers such as OCC, old newspapers (ONP), old magazines (OMG), and mixed office paper, for instance. It can also include high grade fibers such as computer print-out (CPO), white ledges (office paper) and colored ledger (office paper), for instance. The secondary fibers can also include, without being limitative, residential mixed paper, soft and hard mixed papers, boxboard cuttings, mill wrappers, news (de-ink quality or not, special, over-issue, etc.), double-sorted corrugated, new double-lined kraft corrugated cuttings, fiber cores, used brown kraft, mixed kraft cuttings, carrier stock, new colored kraft, grocery bag scrap, kraft multi-wall bag scrap, new brown kraft envelope cuttings, mixed groundwood shavings, telephone directories, white blank news, groundwood computer printout, publication blanks, flyleaf shavings, coated soft white shavings, hard white shavings, hard white envelope cuttings, new colored envelope cuttings, semi bleached cuttings, sorted office paper, manifold colored or white ledger, sorted white ledger, coated book stock, coated groundwood sections, printed bleached board cuttings, misprinted bleached board, unprinted bleached board, bleached cup stock, printed bleached cup stock, unprinted and printed bleached plate stock, and the like. It is appreciated that this enumeration is not limitative and that other secondary fibers can be used.

In an embodiment, the wet mat should contain long and strong fibers such as OCC and recycled kraft board fibers to reduce web break during the embossing process. Long and strong fibers typically have a length longer than 1 millimeter.

The wet mat is then drained to allow water to drain by means of a force such as gravity or a pressure difference.

The wet mat 12 is further partially dewatered in a press unit 29, using press rolls 30, where the wet mat 12 is squeezed, to obtain a wet mat 12 having between about 20 wt % to about 70 wt % solids with an acceptable thickness and smoothness, as is known in the art. In an embodiment, the thickness of the wet mat 12, when measured wet, can vary between 250 and 5000 micrometers. In an alternate embodiment, the wet mat 12 has 40 to 60 wt % solid at the entry of the wet embossing process step.

In the embodiment shown in FIG. 1, a double felt press, with one felt 32 on each side of the web 12, is used. However, it is appreciated that in alternate embodiments, other presses such as, for instance, smoothness presses and shoe presses can be used.

The wet mat 12 is then pressure molded in an embossing unit 33, with two embossing rolls 34, 36, each rotatable on an axis, the axes being parallel to one another. In an embodiment, the embossing roll 34 is a male roll since it includes a plurality of embossing knobs, or protrusions, on it surface. The other embossing roll 36 is a deformable rubber roll, having a substantially smooth outer surface, to create a nested surface texture thereon.

In an alternate embossing process, the second roll 36 includes depressions which corresponds to the embossing knobs extending outwardly from the male embossing roll 34. The protrusions and the depressions are disposed in a non-random pattern where the respective non-random patterns are coordinated with each other. The embossing rolls are axially synchronously rotated with the protrusions and the depressions being in register to create nested protrusions and depressions in the wet mat 12.

In another alternate embodiment, both embossing rolls 34, 36 include protrusions and the wet mat 12 is embossed on both sides, i.e. protrusions and depressions are provided on both sides of the resulting paperboard. The embossing rolls 34, 36 can also include depressions which are in register with the protrusions of the opposed roll or the outer surface material of the rolls 34, 36 can be deformable. Thus, the two rolls 34, 36 are aligned such that the respective coordinated non-random pattern of protrusions and nest together such that the protrusions of the two rolls 34, 36 mesh each other.

All alternate embossing apparatuses produce a pattern of protrusions and depressions in the cellulose fibrous structure of the wet mat 12, thereby increasing the wet mat specific volume. If only one male embossing roll 34, i.e. including protrusions, is used, the paperboard 14 is only embossed on one side, the other side of the paperboard 14 having corresponding depressions. On the opposite, if two embossing rolls 34, 36 are used, depressions and protrusions are provided on both sides of the paperboard 14.

In an embodiment, the wet mat 12 is carried between two embossing rolls 34, 36 which are not heated.

Usually, when manufacturing a paperboard web, the paperboard speed along the manufacturing apparatus is continually increased. Thus, from the press unit 29 towards the drying unit 38, the paperboard web accelerates. The paperboard web, which is a viscoelastic material, slightly stretches in each unit.

On the opposite, in the wet embossing unit 33, the wet mat 12 decelerates. The wet mat 12 is carried at a slower speed in the embossing unit 33 than in the press unit 29. The wet mat 12 slowly accelerates in the drying unit 38.

In an embodiment, if the drying unit 38 includes several drying rolls 40, the wet mat 12 can still decelerates in the first drying rolls 40 and accelerate thereafter. In an alternate embodiment, the paperboard web accelerates as soon as it enters the drying unit 38.

Thus, in the embossing unit 33, the wet mat 12 retracts instead of stretching. In an embodiment, both embossing rolls 34, 36 have a 12 inch diameter. Moreover, the solid content of the wet mat increases in the embossing unit since water is released during embossing. It is appreciated that in alternate embodiments, the embossing rolls 34, 36 can have a different diameter and their diameter can range between 10 and 60 inches.

In the embossing unit 33, the embossing rolls 34, 36 apply a pressure ranging between 50 and 600 pounds per linear inch (PLI). In an alternate embodiment, the pressure applied to the wet mat 12 can range between 100 and 500 PLI, preferably between 250 and 400 PLI, and typically between 250 and 295 (the range of 250 to 295 can be associated with embossed paperboards having 7 to 9 paper plies, for example). The pressure can be controlled by adjusting the spacing between both rolls 34, 36 and is selected in accordance with the wet mat thickness. Less pressure is applied to the wet mat 12 if the spacing is wider while, on the opposite, an increased pressure is applied to the wet mat 12 if the spacing is narrower. In an embodiment, the spacing between the embossing rolls 34, 36 can range between 1 and 100 milli-inch (mils). The spacing between the embossing rolls 34, 36 is measured from the top of a peak to the bottom of the matching one if both embossing rolls 34, 36 have embossing knobs or between the peak of an embossing knob and the substantially smooth outer surface of the opposite embossing roll.

In an embodiment, the wet embossed mat 12 can be sprayed with an anti-adhesive product before being inserted or while being carried between the embossing rolls 34, 36. The anti-adhesive product, such as vegetal oil, for instance, greases the embossing rolls 34, 36 and prevents the wet embossed mat from entirely or partially adhering to the embossing rolls 34, 36.

Figure 4:
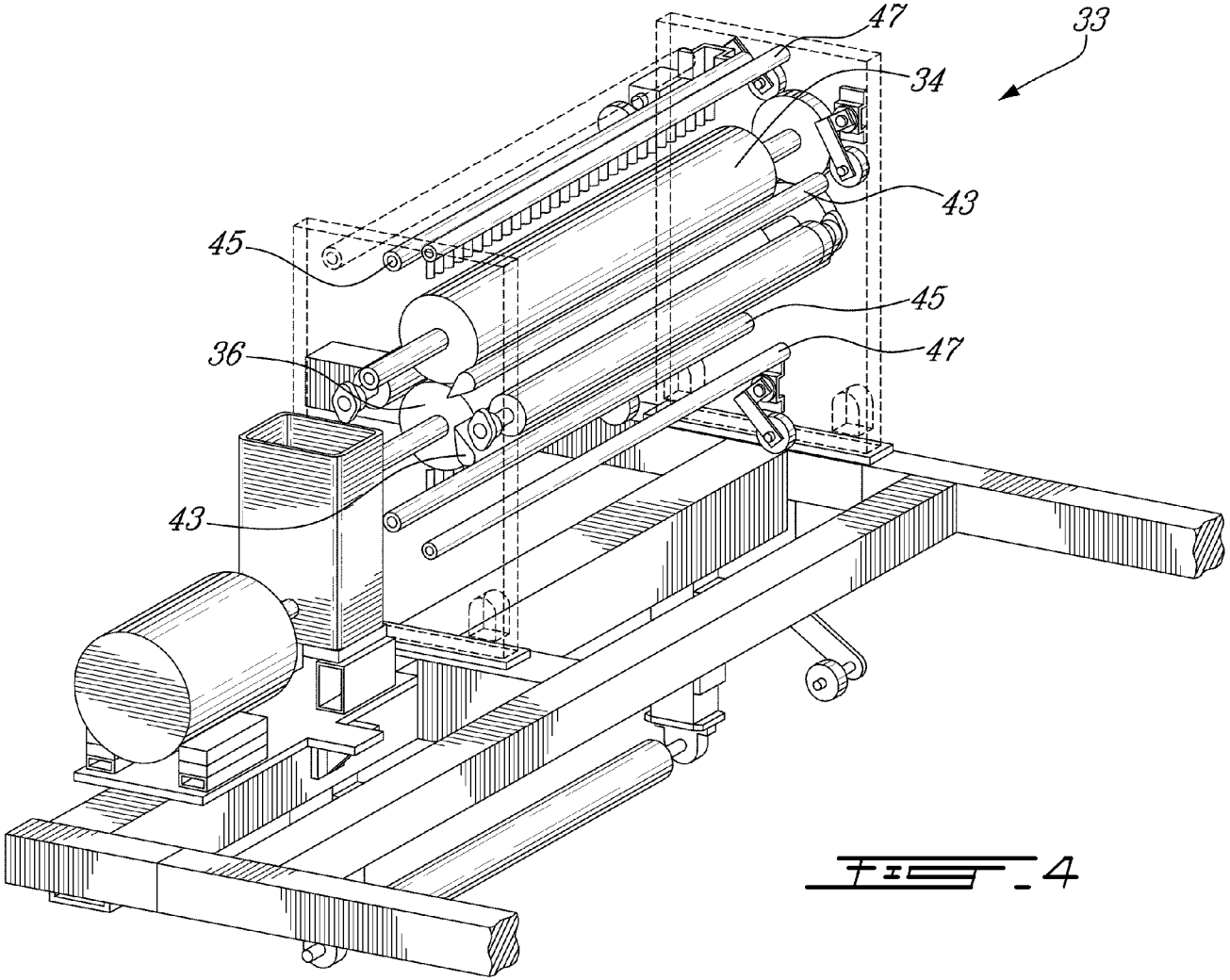
FIG. 4 is a perspective view of a wet embossing apparatus in accordance with an embodiment.

Referring to FIG. 4, there is shown an embodiment of a wet embossing apparatus 33 having two embossing rolls 34, 36, with parallel rotation axis, and a nip therebetween in which the wet mat is inserted. The embossing apparatus can include, for instance, suction boxes 43 to adequately remove excess water and prevent web crushing, anti-adhesive applicators 45, and air jet cleaning apparatuses 47 mounted proximate to the embossing rolls 34, 36.

Finally, referring back to FIG. 1, the wet embossed mat 12 is then dried in a drying unit 38 having multiple drying rolls 40 to obtain the embossed paperboard 14. The drying rolls 40 can be heated and the wet mat 12 is dried through contact with the rolls 40 or the dryer 38 can have blowers (not shown) which generate warm air currents within the dryer 38. For instance, without being limitative, other drying systems can be used to dry the wet embossed mat 12 such as drum dryers, filled with steam, infra red dryers, air dryers, evaporation tables, ovens (forced convection drying), dryer felts, etc.

The embossed paperboard 14, once dried, has a thickness ranging between 0.01 and 0.2 inch and a grammage above 125 and below 1500 grams per square meter. This grammage is measured in the dried finished product but depends on the dewatering and wet mat formation process.

It should be noted that drying, with drying rolls, a wet embossed mat 12 is more difficult than drying a non-embossed mat because once embossed the mat has less surface in contact with the drying rolls. However, embossing allows to reduce the quantity of fibers used for a given thickness and there will be thus less fibers to dry.

Using the wet embossing technique described above, embossed paperboards having a specific volume density ranging between 1 and 6 square centimeters per gram, a tensile strength ranging between 100 and 700 newtons per inch, a thickness ranging between 500 and 2,500 micrometers and a grammage ranging between 125 and 2,500 grams per square meter can be obtained. The embossed paperboard is produced with a moisture content below 15 wt %. In an alternate embodiment, the embossed paperboard is produced with a moisture content below 10 wt %.

The properties of the embossed paperboard vary in accordance with the feed material content (% of fibers, fiber nature, % inorganic filler, inorganic nature, etc.), the embossing process operating parameters, the embossing pattern, the embossing unit (one or two male embossing rolls), amongst others. The wet nested embossed paperboard has a specific volume gain while reducing mechanical property losses comparatively to dry embossing. More particularly, the specific volume gain is more important than with prior art dry embossing technique.

Figure 5A:
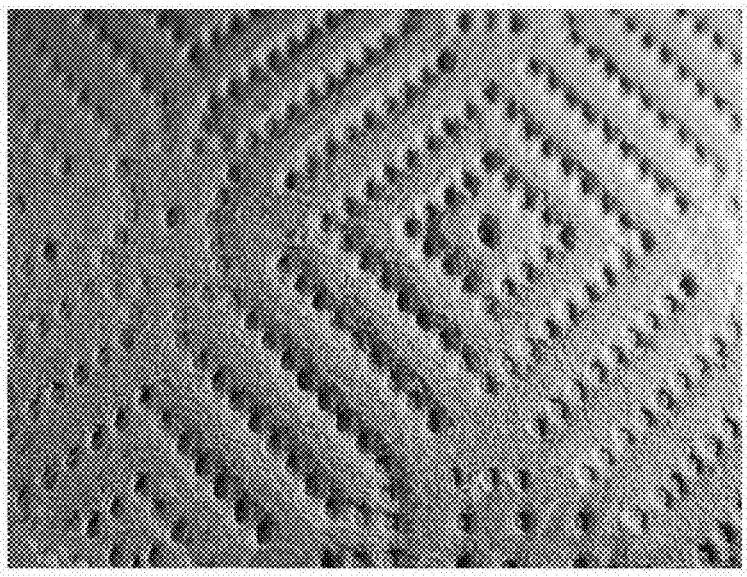
FIG. 5A is a micrograph of a depressed surface of a nested embossed paperboard.

FIG. 5A shows a surface of the embossed paperboard made using the present wet nested embossing technique. The surface of the paperboard shown is the surface which was depressed using the protrusions on the male embossing roll 34, the opposite roll 36 having a substantially smooth outer surface. Each dot is a depression caused by a protrusion on the male embossing roll 34. This creates a corresponding protrusion on the other surface of the paperboard (not shown). The other surface is therefore the surface having a raised volume. Depending on the proximity of the protrusions on the male embossing roll 34, the resulting raised volume on the other surface of the paperboard can appear to be raised continuously along a line or raised with a dotted pattern along a line.

Other shapes and sizes of protrusions can be used to create corresponding shapes of depressions and protrusions on the surface of the paperboard. For example, a star-headed protrusion can be provided on the embossing roll to create star-shaped depressions and protrusions in the embossed paperboard.

Different sizes of protrusions on the male embossing roll 34 can also be provided to create interesting patterns on the paperboard, as it will be described in more details below in reference to FIGS. 12 to 22. It should be noted that any embossing pattern respecting the required physical characteristics of the embossed paperboard can be produced by the present wet embossing technique and that the pattern shown is only one example of an embossing pattern. Moreover, the embossing pattern can be created by a combination of knobs provided on both embossing rolls.

Figure 5B:
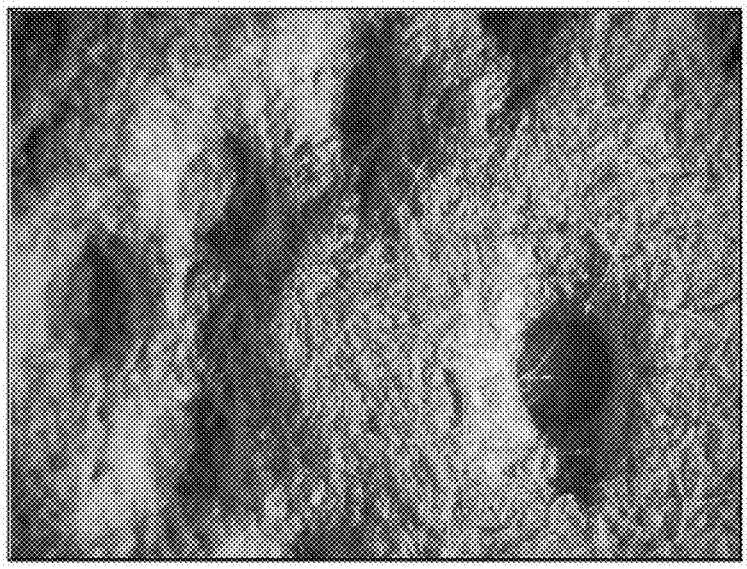
FIG. 5B is a detailed view of the surface of FIG. 5A.
Figure 5C:
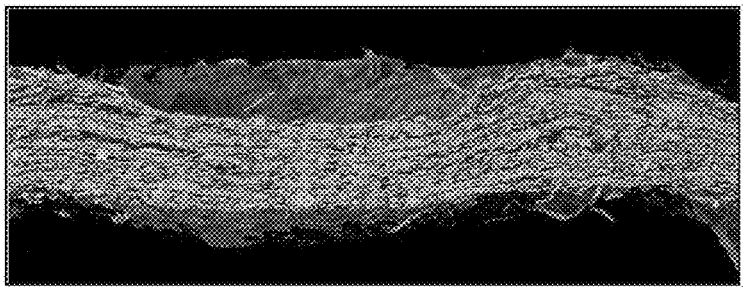
FIG. 5C is a micrograph of a transversal view of the nested embossed paperboard of FIG. 5A, with the depressed surface at the top and the protruding surface at the bottom.

FIG. 5B shows a detail of the surface of FIG. 5A. The fibers are apparent and it can be noted that some fibers were broken by the protrusions of the embossing roll 34. FIG. 5C is a transversal view of the paperboard of FIG. 5A. The top surface is the surface shown in FIG. 5A and the bottom surface is the other surface of the paperboard, the depressed surface is therefore at the top and the protruding surface at the bottom. As is apparent on FIG. 5C, the paperboard is made of a plurality of plies. The top plies have suffered the most damage from the embossing technique with some delaminated plies while the bottom plies have simply curved under the embossing roll pressure.

Figure 6:
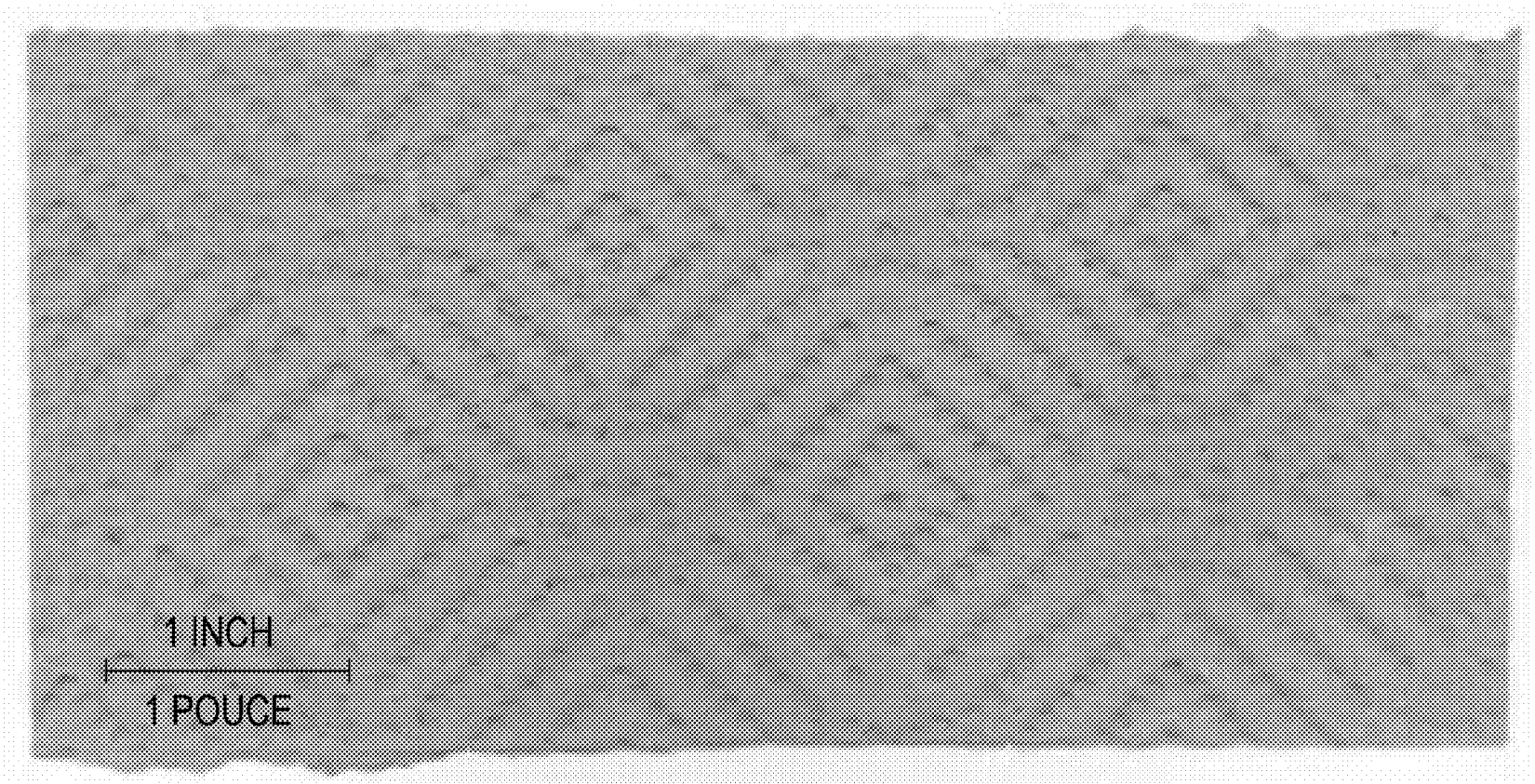
FIG. 6 is a photograph of an example of a nested embossing pattern.

FIG. 6 is an example of a nested embossing pattern that can be created using the present technique and is also an example of an embossed paperboard produced with the present technique.

Figure 7B:
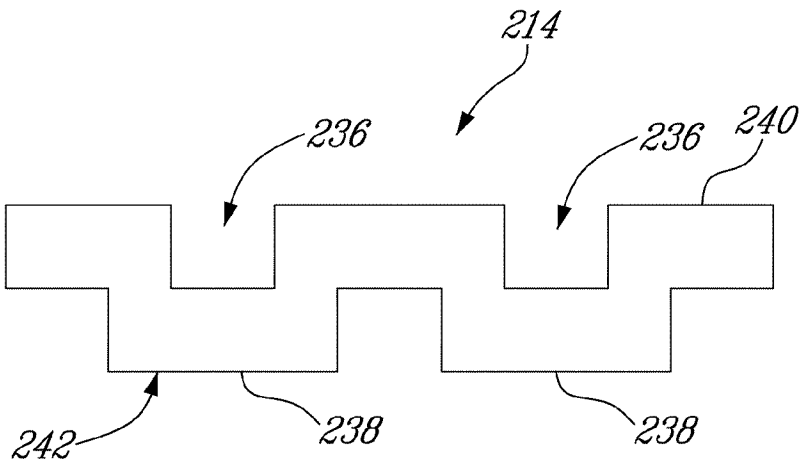
FIG. 7A is a schematic cross-section view of a paperboard which is not embossed and has a first specific volume and FIG. 7B is a schematic cross-section view of the paperboard of FIG. 7A which has been embossed with the present embossing technique and now has a specific volume substantially double of that of the non-embossed paperboard of FIG. 7A.
Figure 7A:
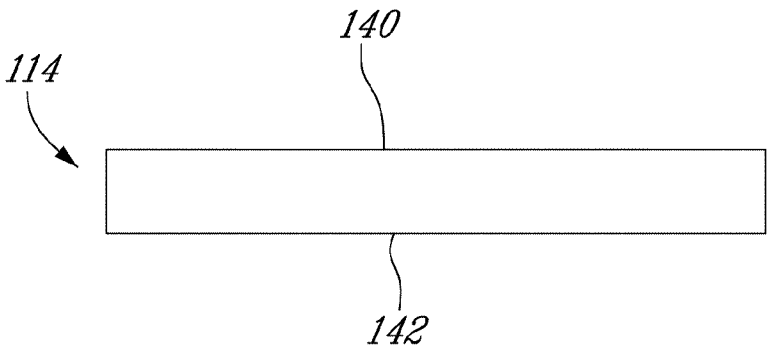

FIG. 7 includes FIG. 7A and FIG. 7B, wherein FIG. 7A shows a schematic transversal view of a paperboard 114 which is not embossed having a top surface 140, an opposed bottom surface 142, and a first specific volume and FIG. 7B shows a representation of a transversal view of the paperboard 214 of FIG. 7A which has been embossed with the present technique and now has a specific volume substantially double of that of the paperboard of FIG. 7A. The protrusions on the male embossing roll have contacted the top surface 140 of the paperboard 114 of FIG. 7A and have created the depressions 236 in the top surface 240 of the paperboard 214 and the corresponding protrusions 238 on the bottom surface 242 of the paperboard 214 as shown in FIG. 7B. The resulting thickness of the paperboard 214 is substantially greater than the thickness of the original non-embossed paperboard 114 with the same amount of fibers used.

Figure 8B:
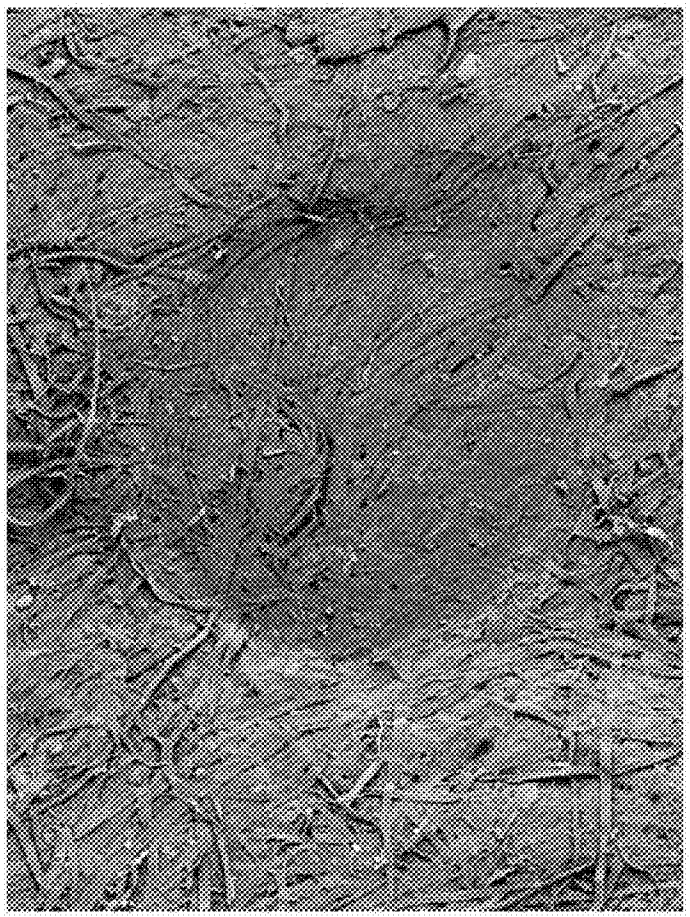
FIG. 8A is a micrograph of the bottom surface of a wet embossed paperboard and FIG. 8B is a micrograph of the top surface of the wet embossed paperboard of FIG. 8A, with the depressed surface at the top and the protruding surface at the bottom.
Figure 8A:
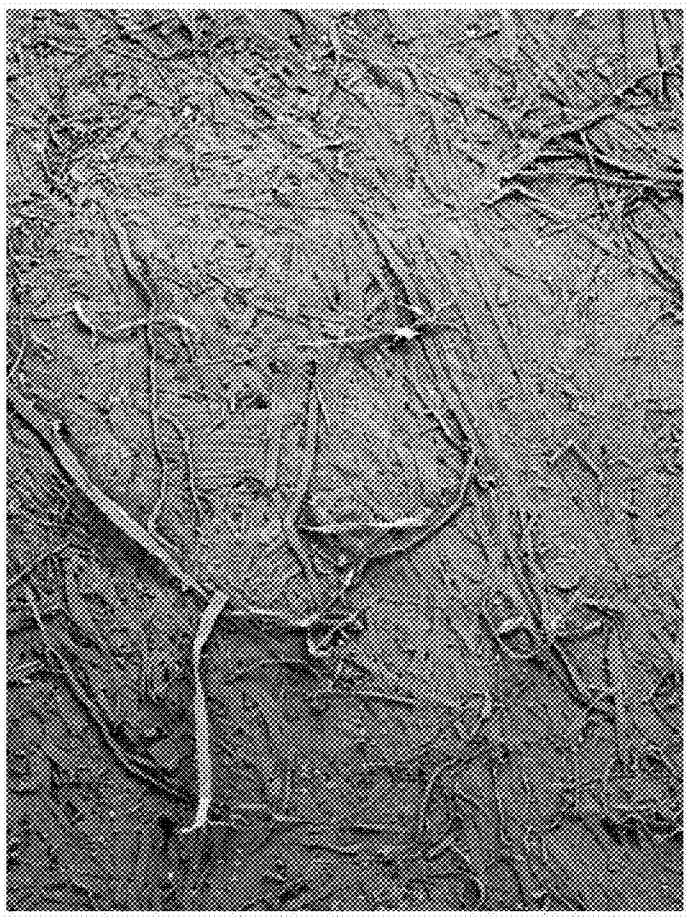

FIG. 8 includes FIG. 8A and FIG. 8B, wherein FIG. 8A shows the bottom surface of a wet embossed paperboard and FIG. 8B the top surface of the wet embossed paperboard of FIG. 8A, with the depressed surface at the top and the protruding surface at the bottom.

Figure 9B:
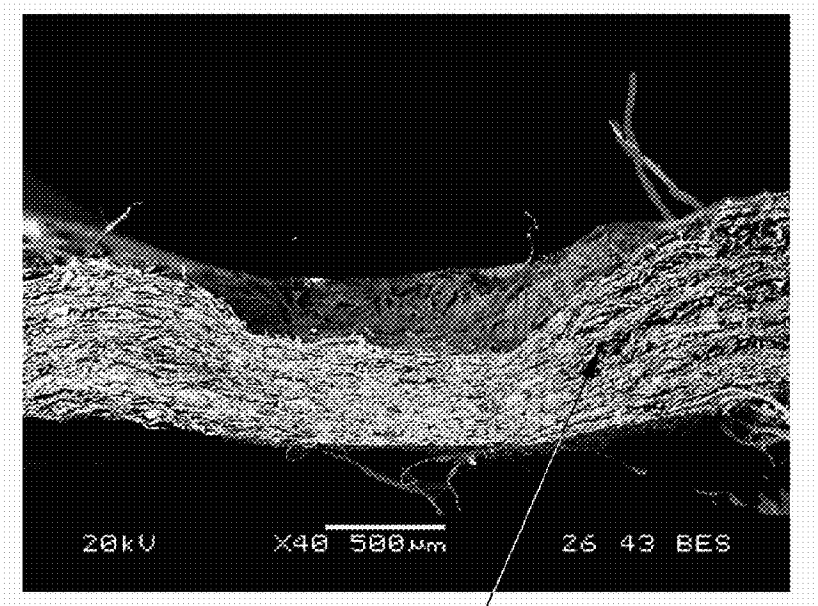
FIG. 9A and FIG. 9B are micrographs of different cross-section views of a wet embossed paperboard, with the depressed surface at the top and the protruding surface at the bottom.
Figure 9A:
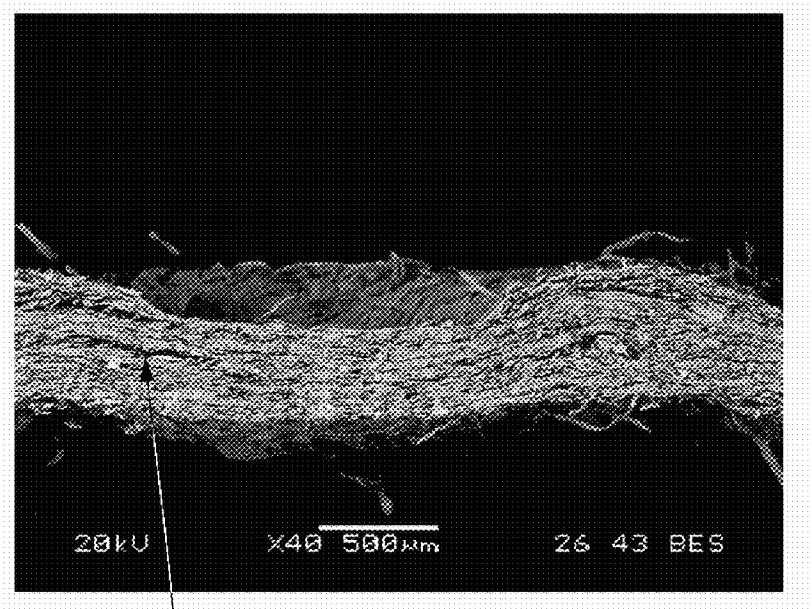

FIG. 9 includes FIG. 9A and FIG. 9B, wherein FIG. 9A and FIG. 9B show transversal views of different portions of a wet embossed paperboard, with the depressed surface at the top and the protruding surface at the bottom. Some delamination of the plies of the paperboard can be noticed but it is relatively minor.

Figure 10B:
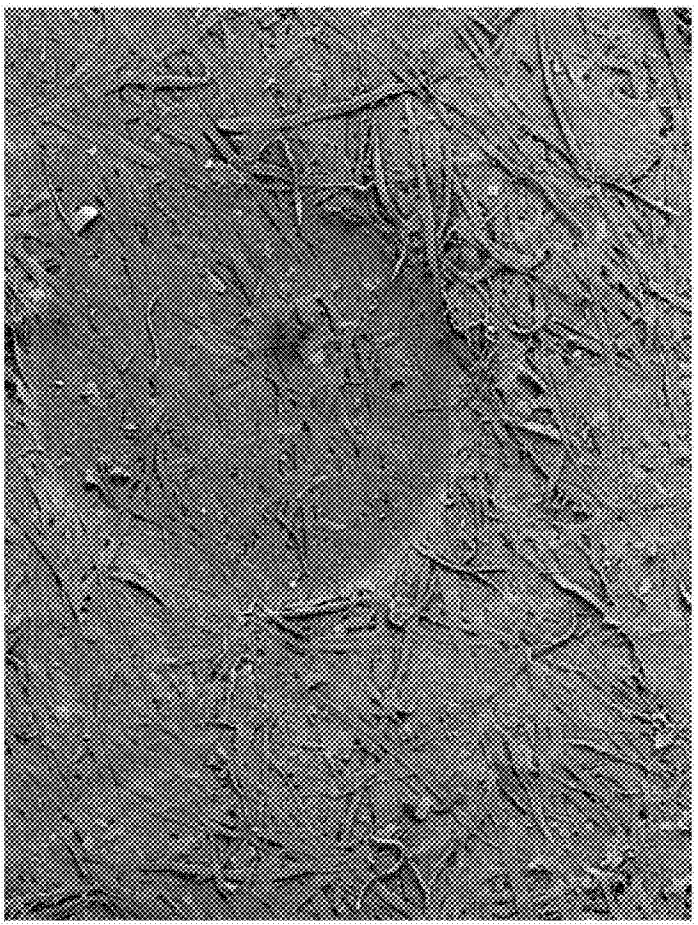
FIG. 10A is a micrograph of the bottom surface of a dry embossed paperboard and FIG. 10B is a micrograph of the top surface of the dry embossed paperboard of FIG. 10A, with the depressed surface at the top and the protruding surface at the bottom.
Figure 10A:
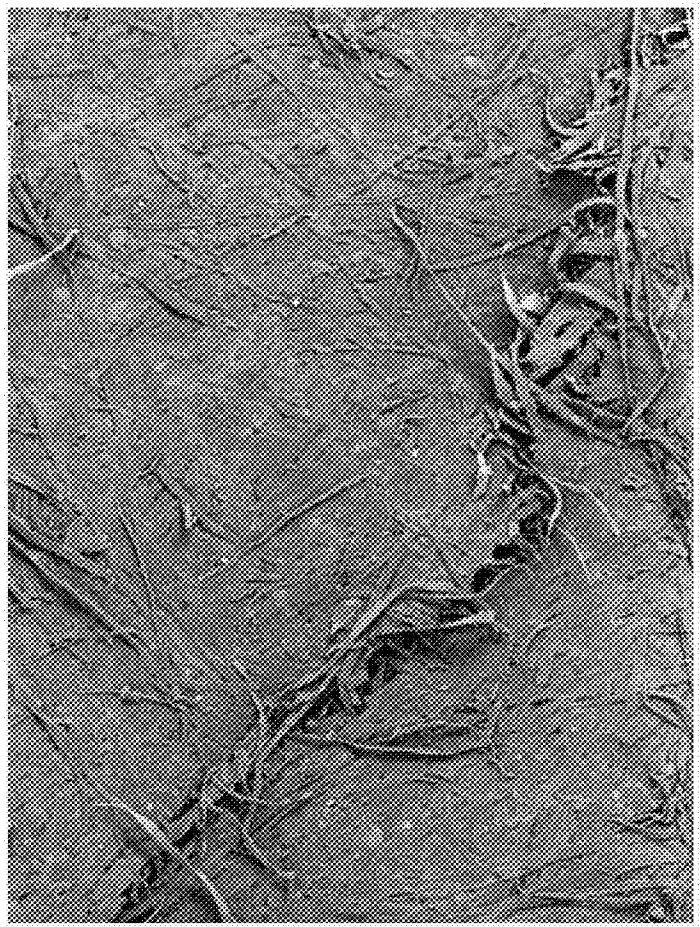

FIG. 10 includes FIG. 10A and FIG. 10B, wherein FIG. 10A shows the bottom surface of a dry embossed paperboard and FIG. 10B the top surface of the dry embossed paperboard of FIG. 10A with the depressed surface at the top and the protruding surface at the bottom. The dry embossed paperboard of FIG. 10 is embossed using prior art techniques.

When compared to the wet embossed paperboard of FIG. 8, one can note that when the protrusion contacted the surface of the paperboard in the dry embossing technique, it created a fracture in the bottom surface of the paperboard (see FIG. 10A). It resulted in an embossed paperboard with inferior mechanical properties than a paperboard embossed when still having a moisture content higher than 30 wt %.

Figure 11B:
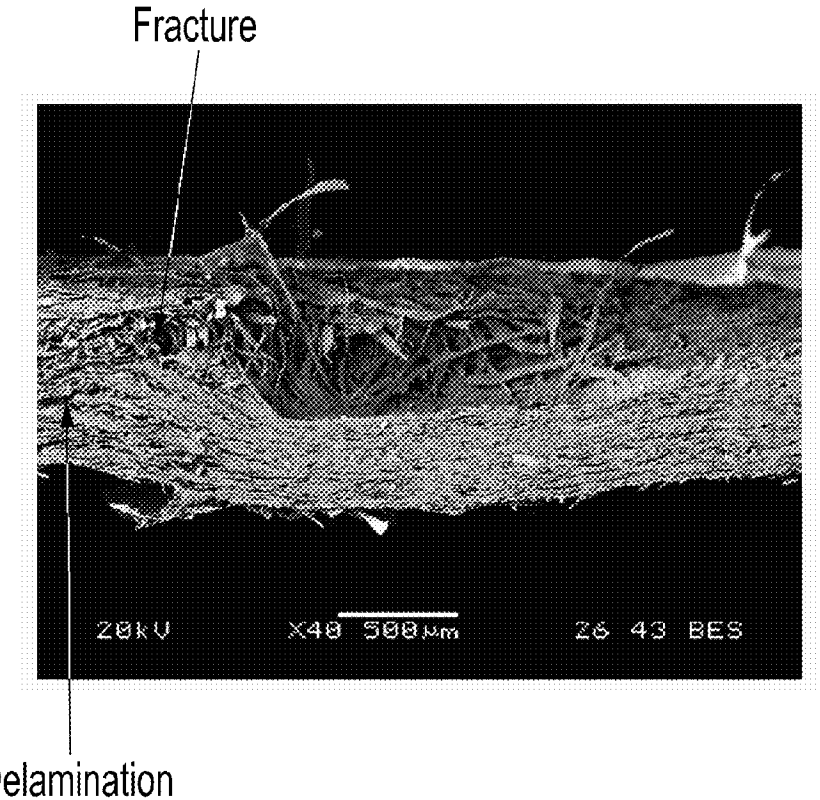
FIG. 11A and FIG. 11B are micrographs of cross-section views of different portions of a dry embossed paperboard, with the depressed surface at the top and the protruding surface at the bottom.
Figure 11A:
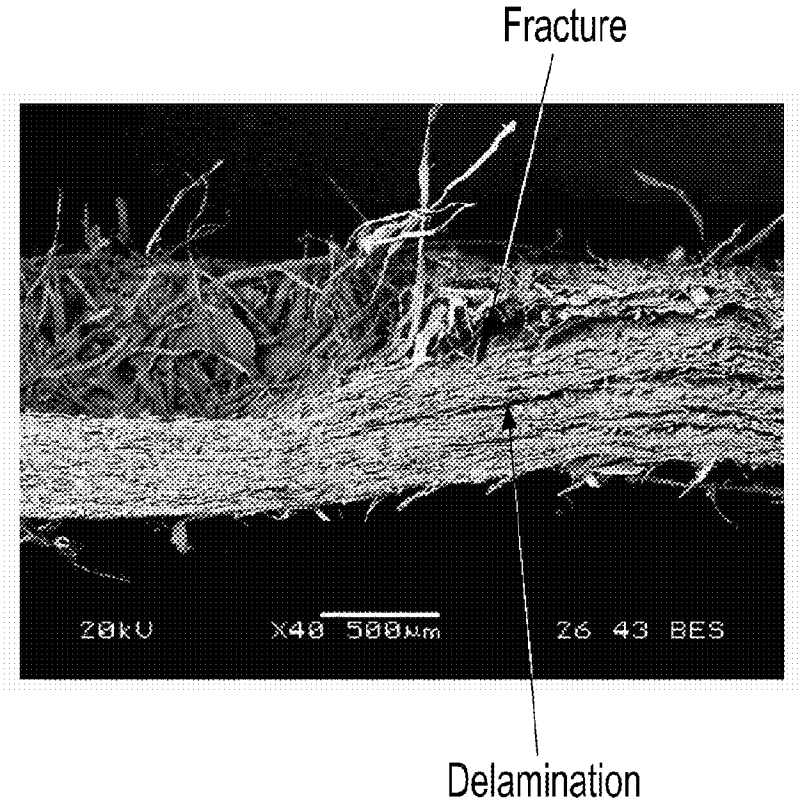

FIG. 11 includes FIG. 11A and FIG. 11B, wherein FIG. 11A and FIG. 11B show transversal views of different portions of a dry embossed paperboard, with the depressed surface at the top and the protruding surface at the bottom.

When compared with the views of FIG. 9, the dry embossing technique was more destructive and created fractures in the paperboard in addition to delamination. As mentioned above, the mechanical properties of a dry embossed board were inferior to the mechanical properties of a wet embossed board, particularly for stiffness. Dry embossing reduced the external as well as the internal mechanical properties of the embossed paperboard.

Table 1 gives an example of the impact of dry and wet embossing on the mechanical properties of paperboards. The embossing was carried out with two embossing rolls. The first embossing roll had embossing knobs on its outer surface while the second embossing roll had a substantially smooth and deformable outer surface.

The mechanical properties were measured in accordance with the industry standards. More particularly, the grammage, the thickness, the specific volume, the Z-direction tensile strength (ZDT), the breaking length, the stretch, the elasticity modulus, and the tensile energy absorption (TEA) were respectively measured in accordance with the standards TAPPI T410, TAPPI T411, Paptac D.4, and T494.

The wet nested embossed paperboard has a gain in specific volume of 68% while having a loss of 52% of Z-Directional Tensile tester (ZDT) and 45% of breaking length. Therefore, the gain in specific volume is greater than the dry nested embossing technique while the loss in breaking length and ZDT is similar to that of dry nested embossing. Wet embossing does not break the surface and create fractures comparatively to dry embossing.

TABLE 1

Mechanical properties and differences between non-embossed paperboards, wet and dry nested embossed paperboards.

| Mechanical Properties | Non-embossed paperboard Result | Wet nested embossed paperboard Result | Wet nested embossed paperboard Difference (%) | Dry nested embossed paperboard Result | Dry nested embossed paperboard Difference (%) |
|---|---|---|---|---|---|
| Grammage ($g/m^2$) | 357 | 347 | −3 | 358 | 0 |
| Thickness (μm) | 628 | 1027 | +64 | 988 | +57 |
| Specific volume ($cm^3/g$) | 1.76 | 2.96 | +68 | 2.76 | +57 |
| ZDT (psi) | 61.1 | 29.6 | −52 | 25.8 | −58 |
| Breaking length (km) | 4.05 | 2.21 | −45 | 2.27 | −44 |
| Stretch (%) | 2.62 | 2.30 | −12 | 1.94 | −26 |
| Modulus of elasticity (Gpa) | 1.55 | 0.49 | −68 | 0.46 | −70 |
| TEA ($J/m^2$) | 232 | 114 | −51 | 90.1 | −61 |

Table 2 shows the thickness variation for dry and wet embossed paperboards following the application of 180 psi load during 1 minute. Two tests were carried. The first test was carried with a relatively high embossing pressure while the second test was carried with a relatively low embossing pressure. The embossing pressure was adjusted by varying the spacing between the embossing rolls.

The thickness variation following compression of the embossed paperboards, shown in Table 2, was more important for dry embossed paperboards since more delamination and fractures occurred during the embossing step. The dry embossed paperboards had thus an inferior compression strength. Therefore, the thickness reduction during winding and reeling is less important for wet embossed paperboards than for dry embossed paperboards.

TABLE 2

Thickness variation following 180 psi load application during 1 minute.

| Embossing pressure | Samples | Spacing (mil) | Thickness prior loading (μm) | Thickness following loading (μm) | Thickness variation (%) |
|---|---|---|---|---|---|
| High pressure | Wet emboss. | 25 | 2974 | 2962 | −0.4 |
| | Dry emboss. | 25 | 2608 | 2222 | −14.8 |
| Low pressure | Wet emboss. | 50 | 2128 | 2099 | −1.4 |
| | Dry emboss. | 40 | 2274 | 1304 | −42.7 |

For two different embossing patterns (Patterns A and B), the effect of the embossing pressure on the mechanical properties of the wet embossed paperboards was evaluated. Pattern A is shown on FIG. 17 while pattern B is shown on FIG. 22. Embossing pattern A had a 100 mil depth while embossing pattern B had a 35 mil depth. The spacing between two consecutive embossing knobs on one embossing roll is 290 and 188 milli-inches for patterns A and B respectively. The mechanical properties obtained were compared to the mechanical properties of a non-embossed paperboard and are shown in Table 3 in percentages.

For embossing pattern A, the thickness gain was higher for high embossing pressure while the embossing pressure had no effect on the thickness gain for the embossing pattern B. A high embossing pressure lowered the stiffness of the resulting wet embossed paperboard.

TABLE 3

Embossing pressure effect on the wet embossed paperboard mechanical properties.

| | Emboss. pattern | | | | | |
|---|---|---|---|---|---|---|
| | Pattern A | | | Pattern B | | |
| | Embossing pressure | | | | | |
| | High (50 mil) | Medium (40 mil) | Low (30 mil) | High (25 mil) | Medium (20 mil) | Low (15 mil) |
| Grammage g/m$^2$) | +6 | +16 | +15 | −2 | +2 | 0 |
| Thickness (μm) | +122 | +100 | +93 | +50 | +50 | +51 |
| Specific volume (cm$^3$/g) | +109 | +73 | +69 | +54 | +48 | +50 |
| ZDT (psi) | −29 | — | — | — | — | — |
| Stiffness (mN) | −55 | −51 | −42 | −52 | −27 | −27 |

In accordance with the embossing pattern, the wet mat thickness, which is related to the wet mat grammage, can or cannot influence the thickness of the resulting wet embossed paperboard as shown in Table 4. The thickness of the sample (736 and 1067 μm) was measured on the dry non embossed paperboard. However, increased wet mat grammages provided stiffer wet embossed paperboards. Thus, the wet embossed paperboard thickness should be controlled by the embossing pressure while the stiffness should be controlled by the wet mat grammage.

TABLE 4

Wet mat thickness effect on the wet embossed paperboard mechanical properties.

| | Thickness (μm) | | | Stiffness (mN) | | |
|---|---|---|---|---|---|---|
| Embossing pressure | Sample 736 μm | Sample 1067 μm | Variation (%) | Sample 736 μm | Sample 1067 μm | Variation (%) |
| | Pattern A | | | | | |
| Medium | 2367 | 2276 | −4 | 518 | 809 | +56 |
| High | 2616 | 2528 | −3 | 508 | 743 | +46 |
| | Pattern B | | | | | |
| High | 1451 | 1710 | +18 | 523 | 800 | +53 |

To evaluate the operational problems which could occur at the end of the embossing unit resulting from embossed mat strength losses, wet tensile tests have been carried. Wet embossed paperboard samples have been wet, sponged, to a solid content ranging between 35 and 39 wt %, and then tested. The results were compared to two non-embossed test webs. The results are shown in Table 9.

Embossing lowered the tensile strength of the embossed paperboard in accordance with the embossing pressure applied.

TABLE 5

Wet state tensile properties.

| Thickness (μm) | Embossing pressure | Tensile property or Variation | Tensile strength (N/m) | Tensile stretch (%) | TEA (J/m$^2$) |
|---|---|---|---|---|---|
| 736 μm | | | 957 | 2.37 | 12.6 |
| | Medium | Tensile property | 398 | — | — |
| | | Variation (%) | −58 | — | — |
| | High | Tensile property | 231 | 9.80 | 11.3 |
| | | Variation (%) | −76 | +315 | −10 |

TABLE 5-continued

Wet state tensile properties.

| Thickness (μm) | Embossing pressure | Tensile property or Variation | Tensile strength (N/m) | Tensile stretch (%) | TEA (J/m$^2$) |
|---|---|---|---|---|---|
| 1067 μm | Test web | Tensile property | 1024 | 2.56 | 12.1 |
| | Low | Tensile property | 591 | 7.12 | 17.6 |
| | | Variation (%) | −42 | +178 | +45 |
| | Medium | Tensile property | 469 | 9.84 | 17.5 |
| | | Variation (%) | −54 | +284 | +45 |
| | High | Tensile property | 272 | 8.58 | 12.3 |
| | | Variation (%) | −73 | +235 | +2 |

It is appreciated that the embossing pattern influences the mechanical properties of the resulting embossed paperboard. If the embossing pattern reproduced on both surfaces of the paperboard are symmetrical, better properties are observed and, more particularly, adhesive application is facilitated.

To obtain symmetrical embossing patterns, two male embossing rolls, including embossing knobs, are used in the embossing unit. The embossing rolls are disposed in a non-random manner where the respective non-random patterns are coordinated with each other. The embossing knobs on a first embossing roll are in register with depressions provided on a second embossing roll. The embossing rolls are axially synchronously rotated. Protrusions and depressions are provided on both sides of the resulting paperboard. Specific volume gain up to 300% can be obtained with symmetrical embossing patterns.

Thus, it has been observed that increasing the embossing pressure reduces the strength of the embossed paperboard while increasing the specific volume gain, the paperboard shrinkage, and the dryness gain for paperboard having the same thickness. Even if increasing the embossing pressure reduces the strength of the embossed paperboard, the strength of wet embossed paperboards is higher than the strength of dry embossed paperboards for the same embossing pressure.

To increase the embossed paperboard strength, the grammage can be increased. Grammage increase also further increases the specific volume gain.

A specific volume gain is generally accompany with an increased shrinkage and grammage.

The paperboard thickness variation can be controlled either by adjusting the embossing pressure or the grammage, depending on the embossing pattern. The embossing pressure can be adjusted by varying the spacing between the embossing rolls.

As mentioned above, the manufacturing speed in the embossing unit is reduced. This is particularly important since the mat shrinks during the embossing process.

Now referring to FIGS. 12 to 22, embodiments of embossing patterns are described. It is appreciated that these embossing patterns are exemplary only and other embossing patterns can be used. The depth of the embossing knob can vary between 30 and 150 mils. Moreover, the spacing between two consecutive embossing knobs can vary between 40 to 1000 milli-inches.

Figure 12:
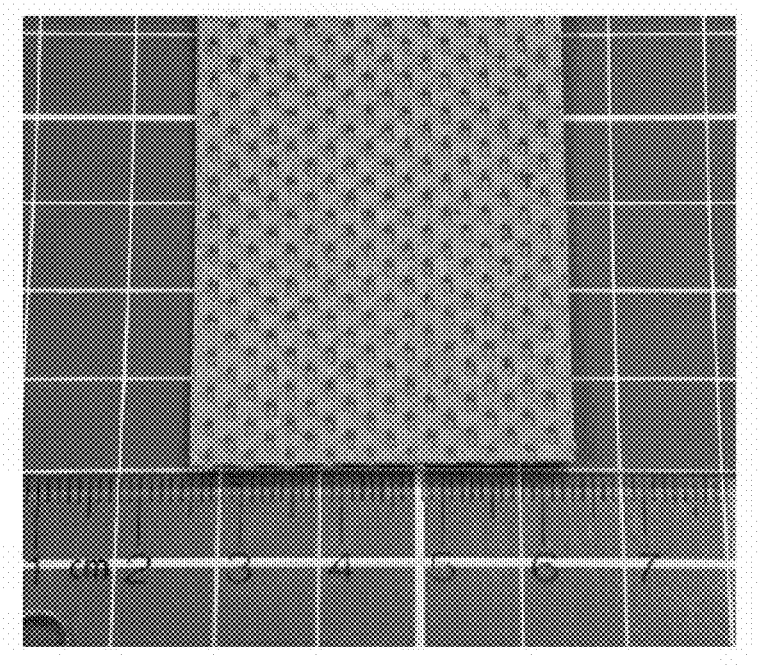
FIG. 12 is a photograph of an embossing pattern in accordance with a first embodiment.
Figure 13:
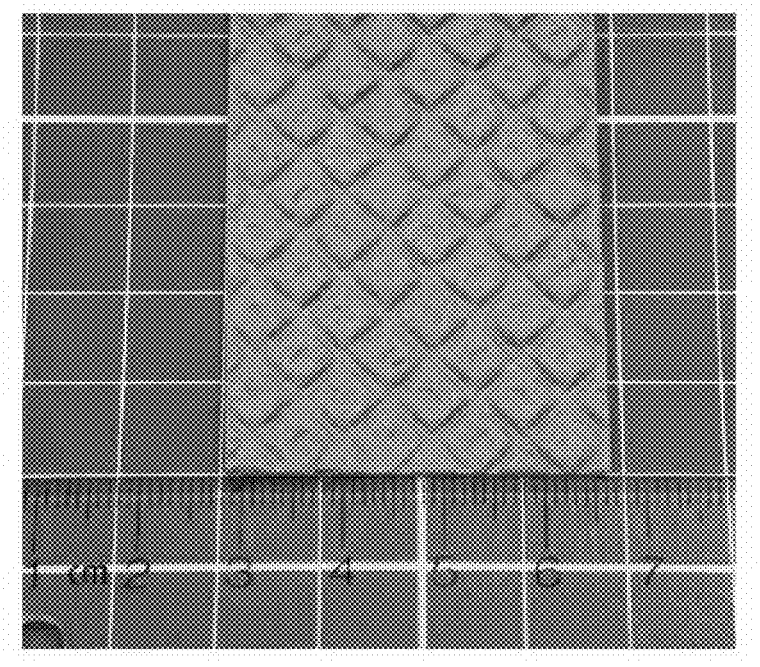
FIG. 13 is a photograph of an embossing pattern in accordance with a second embodiment, wherein the embossing pattern has a 65 mil depth.

Referring to FIGS. 12 and 13, there is shown two embodiments of embossing patterns wherein all the protuberances are located on a same side of the embossed paperboard.

Figure 14:
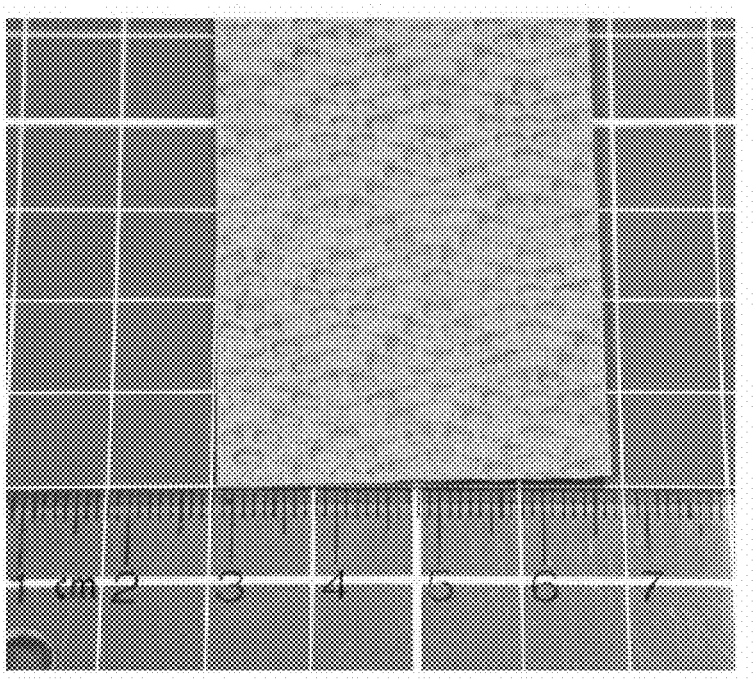
FIG. 14 is a photograph of an embossing pattern in accordance with a third embodiment, wherein the embossing pattern has a 60 mil depth.

On the opposite, the protuberances are located on both sides of the embossed paperboards in the embodiments shown in FIGS. 14 and 15.

Figure 15A:
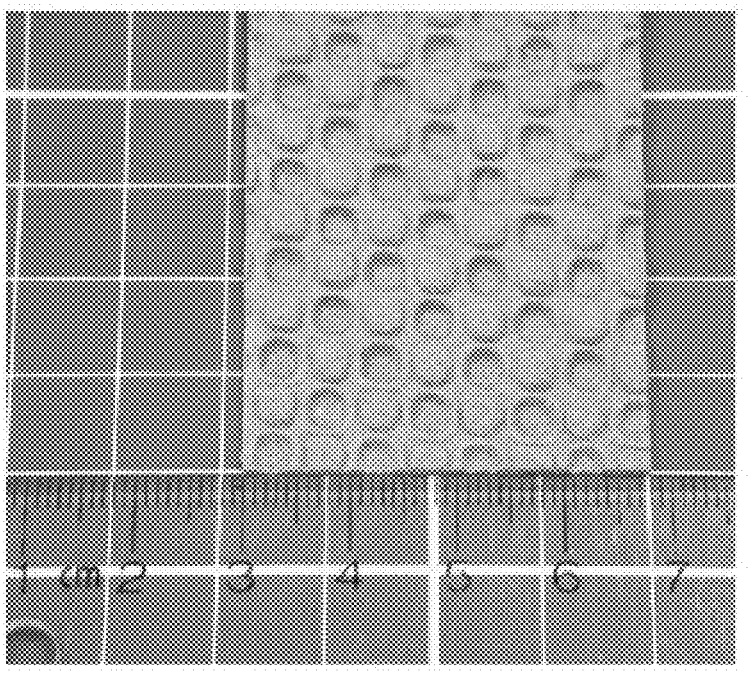
FIG. 15*a* and 15*b*, FIGS. 15*a* and 15*b* are photographs of an embossing pattern in accordance with a fourth embodiment, wherein the embossing pattern has a 135 mil depth and wherein the embossing pattern of FIGS. 15*a* and 15*b* was created with a 25 mil and 50 mil spacing between the embossment rolls respectively.
Figure 15B:
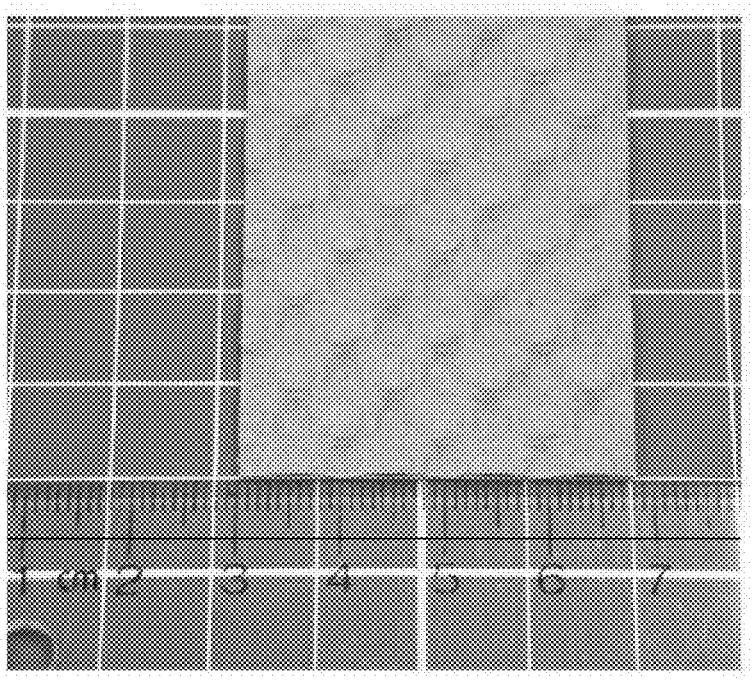
Figure 16:
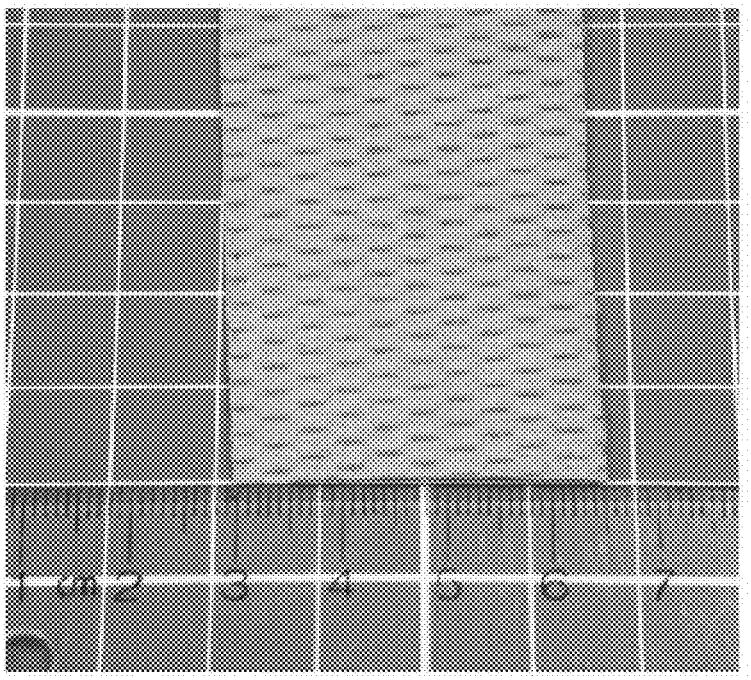
FIG. 16 is a photograph of an embossing pattern in accordance with a fifth embodiment, wherein the embossing pattern has a 125 mil depth.

In the embodiment, shown in FIG. 15, the embossing pattern was created with two embossing pressures. In the embodiment shown in FIG. 15*a*, the spacing between both embossing rolls was 25 mils while, in the embodiment shown in FIG. 15*b*, the spacing between both embossing rolls was 50 mils. Thus, the embossing pressure was higher in the embodiment of FIG. 15*a* and the resulting embossing pattern is more defined.

FIGS. 16 to 22 show alternate embodiments of embossing patterns.

Figure 17A:
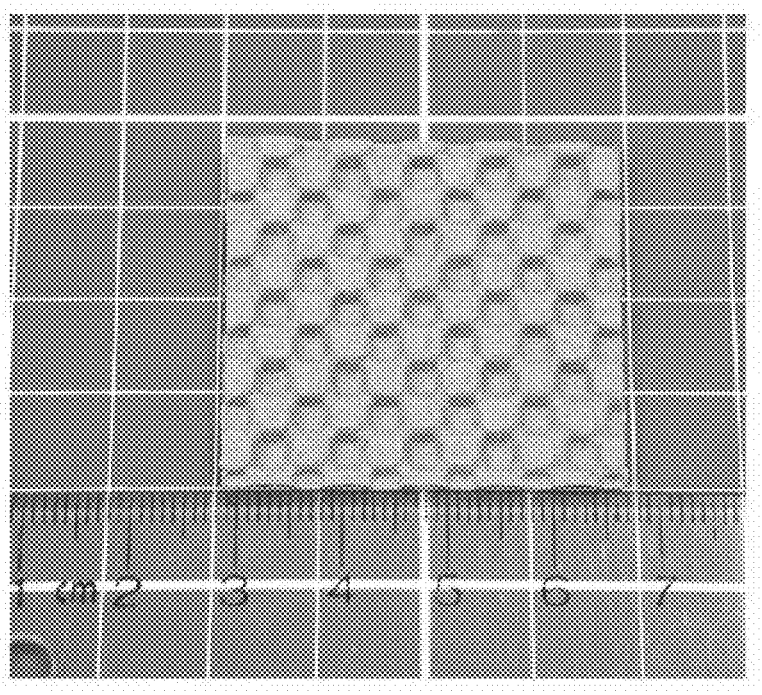
FIGS. 17*a* and 17*b*, FIGS. 17*a* and 17*b* are photographs of an embossing pattern in accordance with a sixth embodiment, wherein the embossing pattern has a 100 mil depth and wherein the embossing pattern of FIGS. 17*a* and 17*b* was created with a 30 mil and 20 mil spacing between the embossment rolls respectively.
Figure 17B:
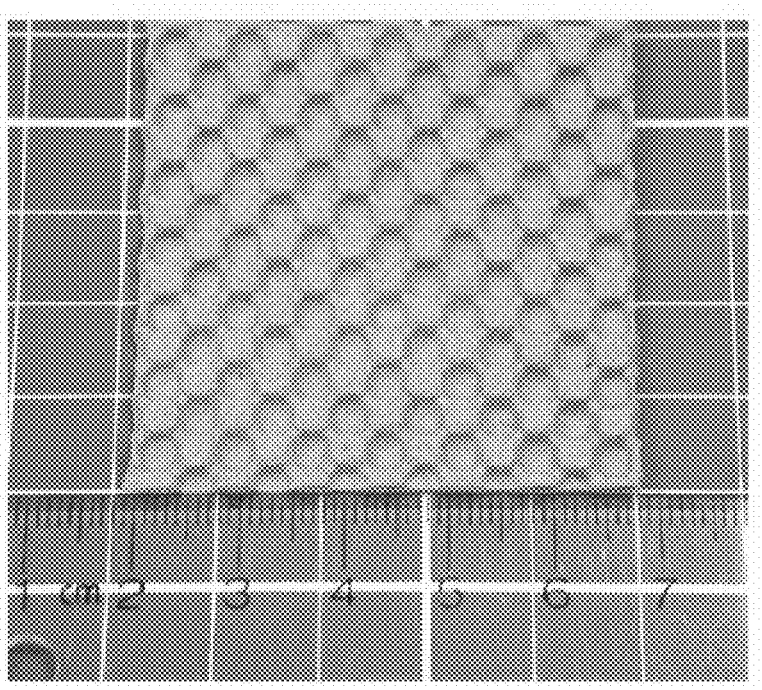
Figure 18:
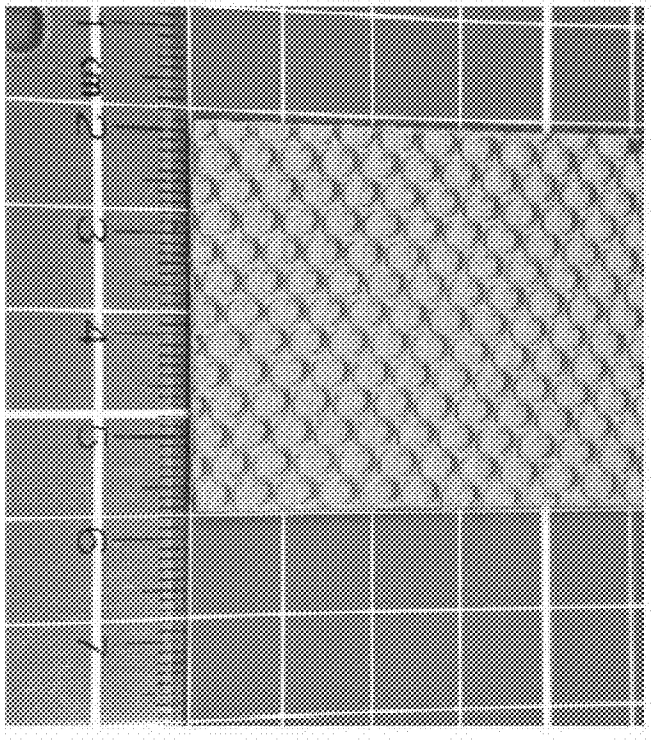
FIG. 18 is a photograph of an embossing pattern in accordance with a seventh embodiment, wherein the embossing pattern has a 70 mil depth.
Figure 19:
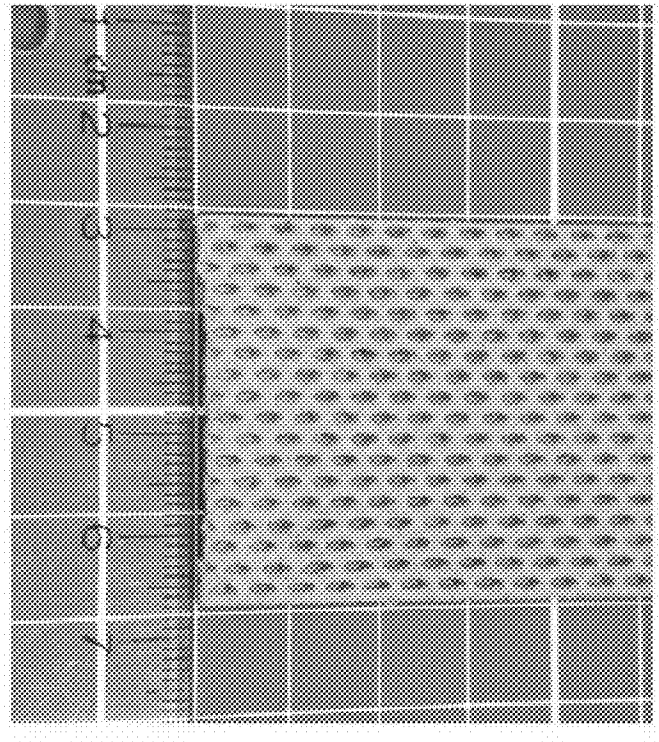
FIG. 19 is a photograph of an embossing pattern in accordance with a eighth embodiment, wherein the embossing pattern has a 70 mil depth.
Figure 20:
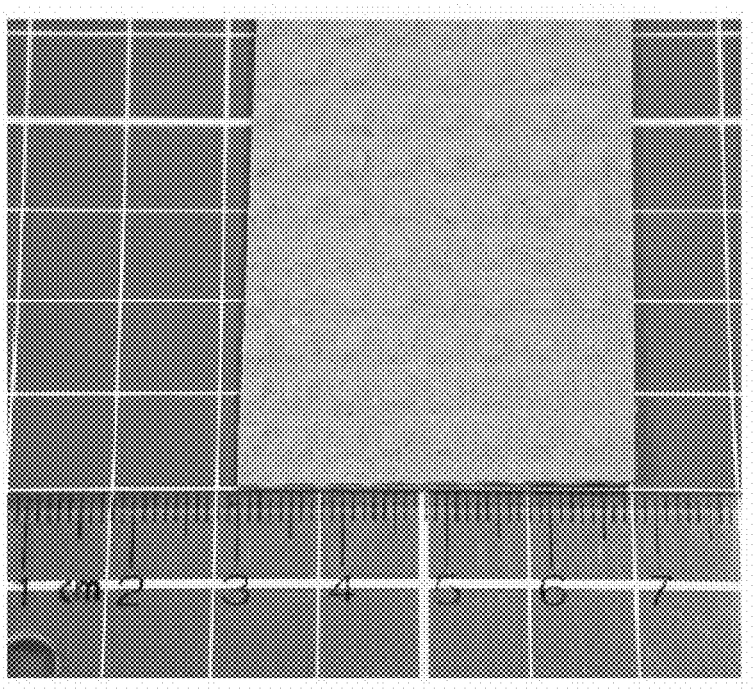
FIG. 20 is a photograph of an embossing pattern in accordance with a ninth embodiment, wherein the embossing pattern has a 60 mil depth.
Figure 21:
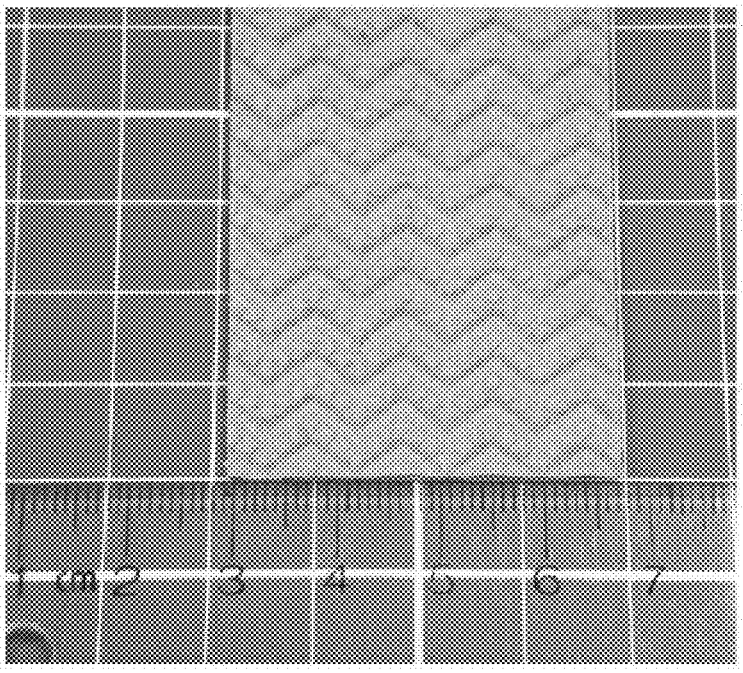
FIG. 21 is a photograph of an embossing pattern in accordance with a tenth embodiment, wherein the embossing pattern has a 60 mil depth.
Figure 22:
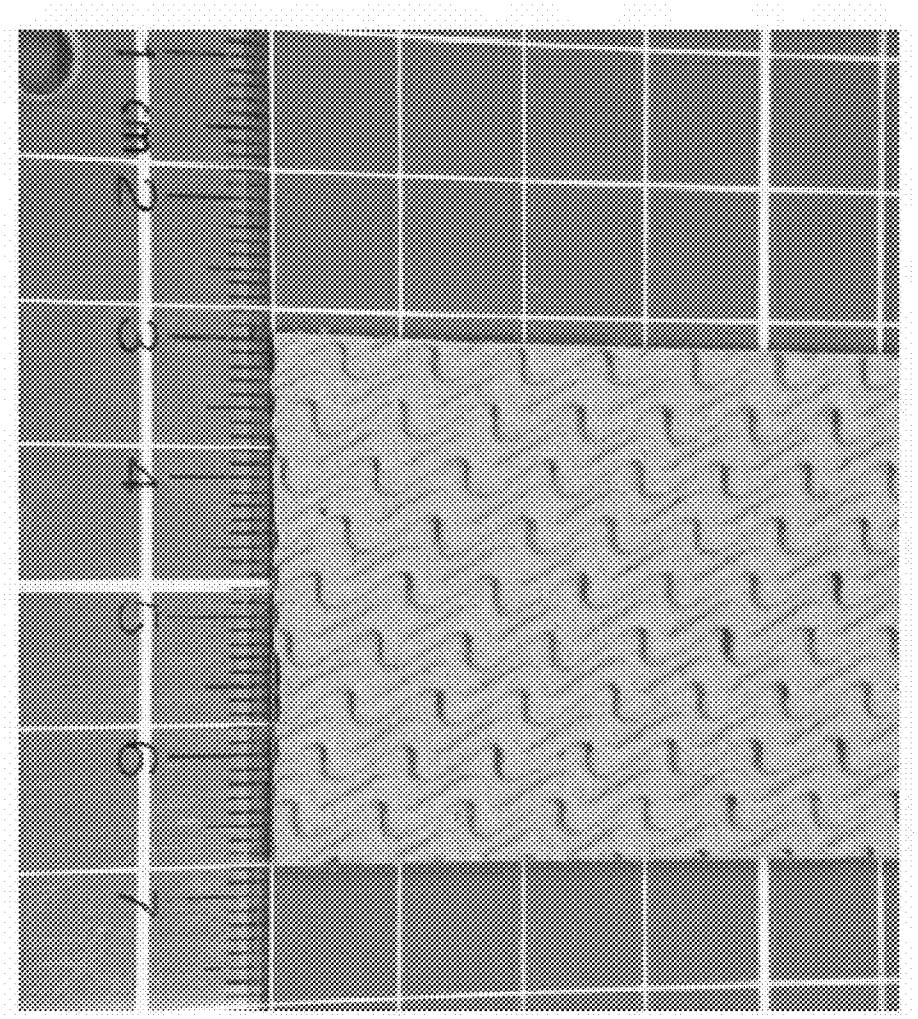
FIG. 22 is a photograph of an embossing pattern in accordance with a eleventh embodiment, wherein the embossing pattern has a 35 mil depth.

Similarly to FIG. 14, in FIG. 17, the embossing pattern was created with two embossing pressures. In the embodiment shown in FIG. 17*a*, the spacing between both embossing rolls was 30 mils while, in the embodiment shown in FIG. 15*b*, the spacing between both embossing rolls was 20 mils. Thus, the embossing pressure was higher in the embodiment of FIG. 15*b* and the resulting embossing pattern is more defined.

The embodiments of the invention described above are intended to be exemplary only.

It is appreciated that the wet embossing process described above can be carried out not only to increase the bulk of the paper web but also for aesthetic purposes.

The scope of the invention is therefore intended to be limited solely by the scope of the appended claims.

The invention claimed is:

1. A process for manufacturing an embossed paperboard comprising the steps of:

forming a wet mat including more than 60 wt % of cellulose fibers;

pressure molding, with at least one unheated embossing roll by applying a pressure greater than 200 pounds per linear inch (PLI), the wet mat having 20 to 70 wt % solid to create a nested surface texture thereon; and drying the embossed wet mat to obtain the embossed paperboard with a grammage ranging between 250 and 1500 grams per square meter.

2. A process as claimed in claim 1, wherein forming the wet mat comprises superposing 2 to 12 paper plies.

3. A process as claimed in claim 1, wherein forming the wet mat comprises superposing 7 to 9 paper plies.

4. A process as claimed in claim 1, wherein the embossed paperboard obtained during the step of drying has a grammage ranging between 250 and 1200 grams per square meter.

5. A process as claimed in claim 1, wherein the embossed paperboard obtained during the step of drying has a grammage ranging between 250 and 900 grams per square meter.

6. A process as claimed in claim 1, wherein the embossed paperboard obtained during the step of drying has a grammage ranging between 300 and 500 grams per square meter.

7. A process as claimed in claim 1, wherein the pressure molding step comprises applying a pressure less than 600 pounds per linear inch (PLI).

8. A process as claimed in claim 1 wherein the pressure molding step comprises applying a pressure ranging between 200 and 400 pounds per linear inch (PLI).

9. A process as claimed in claim 1, wherein the pressure molding step is carried out with two unheated embossing rolls having spaced-apart knobs in meshing engagement, the two embossing rolls being synchronously rotated and being spaced apart from one another by more than 20 mils.

10. A process as claimed in claim 1, comprising decelerating the wet mat for carrying the pressure molding step.

11. A process as claimed in claim 10, comprising accelerating the wet mat for carrying the drying step.

12. A process as claimed in claim 1, comprising withdrawing excess water while carrying the pressure molding step.

13. A process as claimed in claim 1, wherein the solid content of the wet mat ranges between 35 and 55 wt % during the pressure molding step.

14. A process as claimed in claim 1, wherein the wet mat comprises more than 80 wt % of cellulose fibers.

15. A process as claimed in claim 1, wherein the wet mat comprises less than 30 wt % of inorganic fillers.

16. A process as claimed in claim 1, wherein the cellulose fibers of the wet mat comprises more than 60 wt % of recycled fibers.

17. A process as claimed in claim 1, wherein the embossed paperboard has a specific volume density ranging between 1 and 6 cubic centimeter per gram.

18. A process as claimed in claim 1, wherein the embossed paperboard has a tensile strength ranging between 100 and 700 Newtons per inch.

19. A process as claimed in claim 1, wherein the embossed paperboard has a thickness ranging between 250 and 5 000 micrometers.

20. A process as claimed in claim 1, wherein the embossed paperboard has a moisture content below 15 wt %.

21. A process as claimed in claim 1, wherein embossed paperboard has a grammage ranging between 250 and 900 grams per square meter.

* * * * *